United States Patent [19]

Taylor

[11] 3,978,685

[45] Sept. 7, 1976

[54] MEANS FOR TRAPPING OIL LOST DURING STARTUP OF REFRIGERANT COMPRESSORS

[75] Inventor: David H. Taylor, Minneapolis, Minn.

[73] Assignee: Thermo King Corporation, Bloomington, Minn.

[22] Filed: July 14, 1975

[21] Appl. No.: 595,983

[52] U.S. Cl. ..... 62/471; 62/84

[51] Int. Cl.[2] ..... F25B 43/02

[58] Field of Search ..... 62/84, 471, 503, 193, 62/473

[56] References Cited

UNITED STATES PATENTS

| | | | |
|---|---|---|---|
| 2,048,025 | 7/1936 | Philipp | 62/471 |
| 2,537,720 | 1/1951 | Wagner | 62/471 |
| 2,813,404 | 11/1957 | Hirsch | 62/471 |

*Primary Examiner*—William E. Wayner
*Attorney, Agent, or Firm*—C. F. Renz

[57] ABSTRACT

This invention relates to a compression refrigeration system having means for removing some of the oil refrigerant foam which is formed in a crankcase at startup. The removal of foam with entrained oil from the crankcase is to reduce the amount of oil pumped with the refrigerant through condenser and evaporator and at the same time rapidly return oil to the crankcase during startup. In one embodiment of the invention, oil refrigerant foam goes from the crankcase to a foam trap where the foam collapses, the oil drains back to the crankcase, and the refrigerant vapor is drawn to an intake of the compressor. In another embodiment, oil refrigerant foam passes to a suction accumulator where the foam collapses, refrigerant vapor is drawn to an intake of the compressor and the vapor carries droplets of separated oil to a point where they drain back to the crankcase.

5 Claims, 2 Drawing Figures

MEANS FOR TRAPPING OIL LOST DURING STARTUP OF REFRIGERANT COMPRESSORS

CROSS REFERENCES TO RELATED APPLICATIONS

So far as known, this application is not related to any pending patent application.

BACKGROUND OF THE INVENTION

In the compressor of refrigeration systems that use a reciprocating compressor, a reservoir of oil is maintained in the crankcase below the reciprocating piston. In normal operation, elements rotating in the crankcase will dip into the reservoir of oil and splash the oil so it will work into the moving parts. The system should be designed to have as little oil as possible pass with the refrigerant to condenser and evaporator because presence of oil in the condenser and evaportor decreases the efficiency of these elements. Oil that does pass to the condenser and the evaporator should be returned to the crankcase.

In systems which use an oil that is miscible with the refrigerant, liquid refrigerant will be asorbed in the oil during shutdown. This is particularly the case of transportation refrigerator equipment, which must have a large supply of reserve refrigerant to take care of varying compressor speeds during travel and varying refrigeration loads due to different cargos and different external conditions.

If during startup, the pressure on the oil refrigerant mixture in the crankcase is suddenly reduced it will boil violently. If provision is not made to handle the foam much oil may be pumped out of the compressor through vents to the suction cavity or past the piston. In severe startup conditions, it is possible for most of the lubricating oil to leave the crankcase before it can be returned from the rest of the system. During the period of low oil level the compressor bearings or other components may become damaged or fail due to inadequate lubrication.

PRIOR ART

U.S. Pat. No. 2,048,025 granted July 21, 1936 to L. A. Philip pertains to a compression refrigeration system that is designed to prevent a sudden reduction in pressure on an oil refrigerant body of liquid in a crankcase of the compressor. A conduit 94 extends from the interior of the crankcase to suction chamber 70 of the compressor. On the lower end of conduit 94 is a restricted orifice 100 that limits the amount of refrigerant vapor that is drawn into suction chamber 70 on startup. In suction chamber 70 oil is separated from the refrigerant and the separated oil is returned to the crankcase through a conduit 90 that has a check valve 92 at its lower end 91, said valve permitting flow of oil from conduit 90 to the reservoir.

U.S. Pat. No. 2,610,480 granted Sept. 16, 1952 to R. G. Briscoe shows that it is an old expedient to use a thickness of porous material to help separate refrigerant vapor and oil in a separator 32 of a refrigeration system.

SUMMARY OF THE INVENTION

This disclosure illustrates means to minimize the oil lost from the compressor of a refrigeration system during startup and sharply reduce the time required to return the portion of the oil that does leave. Means is provided to withdraw from the crankcase part of the oil refrigerant foam generated in the compressor at startup, to collapse the foam, and return separated oil quickly to the crankcase without having to go through condenser and evaporator.

In one embodiment, foam is vented from the crankcase to a foam trap through a conduit that extends to the bottom of the foam trap from a point on the crankcase that is above the oil level in the crankcase when the compressor is not running. The foam collapses in the foam trap and the oil drains back to the crankcase through said conduit. Separated refrigerant vapor is drawn from the top of the foam trap to a suction cavity of the compressor.

In another embodiment, the foam is vented to a suction accumulator where it collapses. Refrigerant vapor is drawn from the accumulator to a suction cavity of the compressor, and this vapor carries with it droplets of separated oil from the accumulator to the suction cavity where the oil returns by gravity to the crankcase.

DESCRIPTION OF THE PREFERRED EMBODIMENTS

Figure 1:
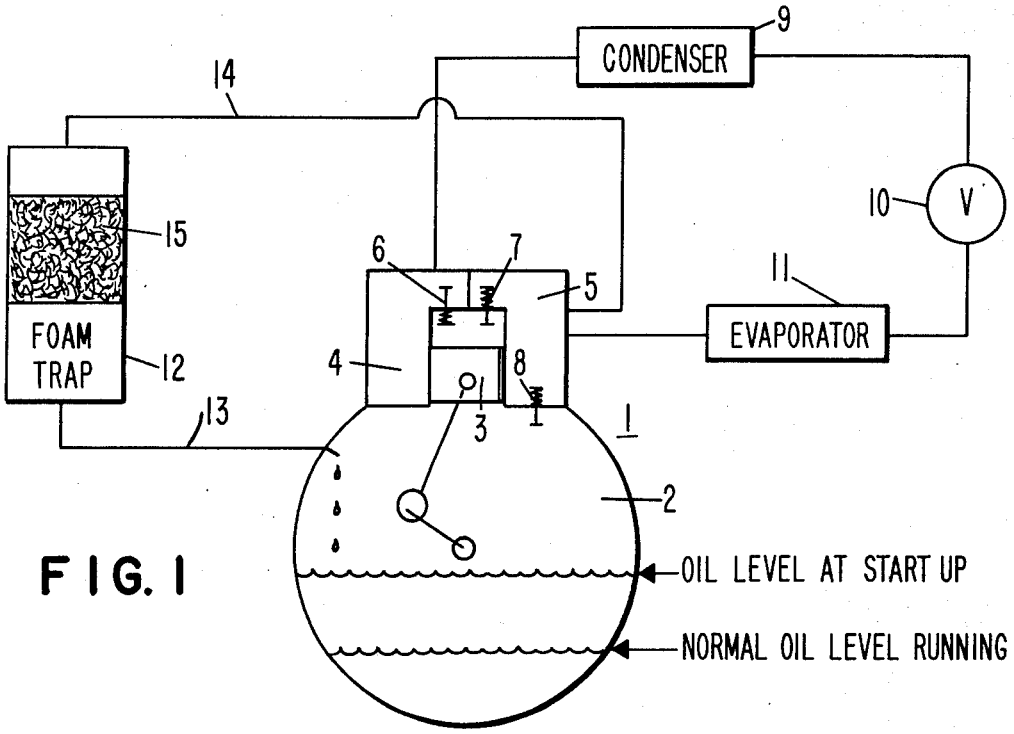
FIG. 1 is a diagrammatic showing of a compression refrigeration system with a foam trap connected to a crankcase and a suction cavity of the compressor.

FIG. 1 shows a compression refrigeration system having a compressor 1 comprising a crankcase 2, a reciprocating piston 3, a compression cavity 4, and a suction cavity 5. The compression cavity 4 has an inlet valve 6 that permits passage of compressed refrigerant into compression cavity 4 during the upstroke of piston 3 and suction cavity 5 has an outlet valve 7 that permits the passage of low pressure refrigerant from the suction cavity during the downstroke of the piston 3. Refrigerant from compression cavity 4 is forced through condenser 9, where it is liquefied, and then through an expansion device 10 to evaporator 11. The pressure on the refrigerant is reduced in evaporator 11 where it evaporates and is drawn to suction cavity 5. In addition to outlet valve 7, suction cavity 5 has an oil return check valve 8 at the bottom thereof and said valve 8 permits oil separated from refrigerant in cavity 5 to drain to crankcase 2.

A foam trap 12 is located at a point higher than the level of the reservoir of oil that stands in the bottom of the crankcase when the compressor is not running. This oil level in the crankcase when the compressor is not running is known as the startup level. During startup there is violent foaming of the oil refrigerant mixture in the bottom of the crankcase. This invention provides a relief for the excess foam. Some of the foam vents through a conduit 13 that extends to the bottom of foam trap 12 from a point in the crankcase located above the oil level at startup. A conduit 14 extends from the top of foam trap 12 to the suction cavity 5 of the compressor. The foam trap 12 is of such a volume and surface that the foam will collapse therein, the oil drains back down through conduit 13 of the crankcase, and the separated refrigerant vapor is drawn through conduit 14 to suction cavity 5.

A material 15 can be used within foam tank 11 to help collapse the foam and separate the oil and refrigerant vapor. This material can be fine mesh such as copper wool or the like, of fine pieces or oil proof packing material that is tightly pressed together.

Figure 2:
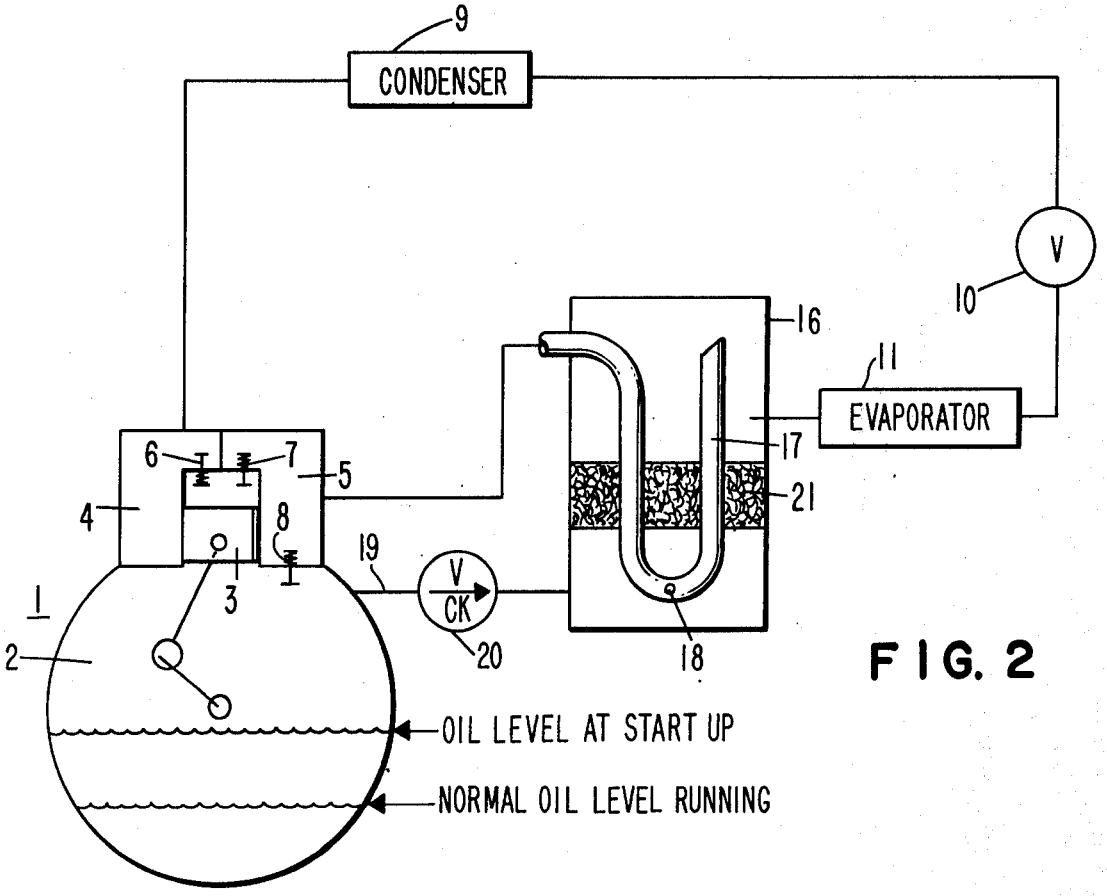
FIG. 2 is a diagrammatic showing of a compression refrigeration system having a combination suction accumulator and foam trap.

FIG. 2 is an embodiment in which an oil foam trap is combined with a suction accumulator tank. In this figure the elements of compressor 1, condenser 9, expansion device 10, and evaporator 11 are the same as in FIG. 1.

In FIG. 2 the refrigerant leaving evaporator 11 passes through an accumulator 16 before returning to suction cavity 5 of the compressor. In accumulator 16 is a U-shaped conduit 17, one end of which opens into the upper part of the accumulator and the other end of which is connected to the return to the suction cavity 5. In the lower part of U-shaped conduit 17 is an oil return hole 18. In the accumulator, refrigerant vapor and any liquid separate. The refrigerant vapor leaves through the open upper end of U-shaped conduit 17 and returns to the suction cavity 5 of the compressor. As the refrigerant sweeps through the U-shaped conduit 17 it draws in a small amount of liquid through oil hole 18. The accumulator described to this point is old in the art.

This invention adds a conduit 19 extending between crankcase 2 and the accumulator 16, said conduit 19 extending from the crankcase 2 at a point above the startup level of the oil in the crankcase. Conduit 19 contains a check valve 20 therein that permits a flow of foam from the crankcase to accumulator 16. When there is excess foam in the crankcase, some of the foam will vent through conduit 19 to accumulator 16. The accumulator 16 can be made large enough to hold and collapse all the foam that need be vented through conduit 19. When the foam collapses it separates into refrigerant vapor and oil, the refrigerant vapor leaves through the open end of U-shaped conduit 17 and droplets of oil are drawn into the vapor through oil hole 18 and carried by the vapor to suction cavity 5 of the compressor. In suction cavity 5 the droplets of oil fall to the bottom of the cavity and descend by gravity through oil return check valve 8 to the crankcase.

Filler material 21 can be placed within the combination accumulator and foam trap 16 to help collapse the foam.

What is claimed is:

1. In a refrigeration system, a compressor comprising a crankcase, a reciprocating piston, a compression cavity, and a suction cavity, and leading from said compression cavity a circuit including in series, a condenser, an expansion device, an evaporator, an accumulator, and a connection to the suction cavity, the refrigeration system containing a refrigerant and oil for lubricating the compressor that form a reservoir of oil liquid refrigerant entrained therein during shutdown of the compressor, a conduit for venting foam from the crankcase to the accumulator, said conduit extending to the accumulator from a point on the crankcase that is above the level of the reservoir of oil refrigerant mixture at startup, said conduit having a check valve therein that permits flow only from the crankcase to the accumulator, the accumulator and return to the suction cavity being constructed so the refrigerant vapor drawn from the accumulator to the suction cavity will carry droplets of oil to the suction cavity.

2. The invention of claim 1, wherein the accumulator is of sufficient volume and surface for collapsing the foam vented thereto.

3. The invention of claim 1, wherein the accumulator has material therein to help collapse the foam vented thereto.

4. The invention of claim 1 wherein the accumulator has a U-shaped conduit standing upright therein and having one end open for refrigerant vapor to enter and the other end connected to the suction cavity of the compressor, the bottom of the U-shaped conduit having an oil return hole therein through which droplets of oil are drawn into the refrigerant vapor being drawing through the conduit.

5. The invention of claim 1, wherein the suction cavity has an outlet in the upper part thereof through which refrigerant vapor is drawn and an oil return check valve in the botton of the cavity to permit oil to drain from the bottom of the cavity to the crankcase.

* * * * *